US012304711B2

(12) United States Patent
Rouleau et al.

(10) Patent No.: US 12,304,711 B2
(45) Date of Patent: May 20, 2025

(54) BI-LEVEL METAL LOCKING CLEAT

(71) Applicant: Panduit Corp., Tinley Park, IL (US)

(72) Inventors: Rodney G. Rouleau, Manhattan, IL (US); Sahar Ramahi, Palos Hills, IL (US); Nicholas M. Molenhouse, New Lenox, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 18/376,670

(22) Filed: Oct. 4, 2023

(65) Prior Publication Data

US 2025/0115403 A1 Apr. 10, 2025

(51) Int. Cl.

| | |
|---|---|
| ***B65D 63/08*** | (2006.01) |
| ***B65D 63/16*** | (2006.01) |
| ***F16L 3/233*** | (2006.01) |

(52) U.S. Cl.

CPC ..... *B65D 63/16* (2013.01); *B65D 2563/107* (2013.01)

(58) Field of Classification Search

CPC .. B65D 63/16; B65D 2563/107; B65D 63/02; B65D 63/04; B65D 63/06; B65D 63/08; B65D 63/12; B65D 63/14; B65D 2563/00; F16B 2/08; F16B 2/065; F16B 2/16; Y10T 24/1457; Y10T 24/1486; Y10T 24/1473; Y10T 24/1414; Y10T 24/1459; B65B 13/30; B65B 13/34

USPC ..... 24/25

See application file for complete search history.

(56) References Cited

U.S. PATENT DOCUMENTS

| | | | | |
|---|---|---|---|---|
| 1,053,684 | A | 5/1918 | Schuttler | |
| 3,015,865 | A | 1/1962 | Rapuzzi | |
| 3,528,142 | A | 9/1970 | Lodholm | |
| 3,530,544 | A * | 9/1970 | Burniston | F16L 3/233 24/16 PB |
| 3,754,303 | A | 8/1973 | Pollock | |
| 4,473,925 | A | 10/1984 | Jansen | |
| 4,646,393 | A | 3/1987 | Young | |
| 4,868,953 | A | 9/1989 | Fortsch | |
| 4,887,334 | A | 12/1989 | Jansen et al. | |
| 8,424,166 | B2 | 4/2013 | Dorneman et al. | |
| 8,635,745 | B2 | 1/2014 | DeBerry et al. | |
| 9,783,350 | B2 | 10/2017 | Mayo et al. | |
| 10,479,572 | B2 | 11/2019 | De Vittori et al. | |
| 11,472,616 | B2 | 10/2022 | Verbeek et al. | |
| 2016/0280433 | A1 * | 9/2016 | Montejo | B65D 63/12 |
| 2022/0033153 | A1 * | 2/2022 | Verbeek | B65D 63/08 |

FOREIGN PATENT DOCUMENTS

| | | |
|---|---|---|
| FR | 1267912 A | 7/1961 |

* cited by examiner

*Primary Examiner* — Jack W Lavinder

(74) *Attorney, Agent, or Firm* — Aimee E. McVady; Christopher S. Clancy; James H. Williams

(57) ABSTRACT

A metal locking cleat secures cable bundles while withstanding impulse forces and short circuit events. The metal locking cleat has a housing, a tie body, and a metal locking head. The housing has a top, a bottom, sides, a front, a back, an upper level, and a lower level. The tie body is positioned in the lower level of the housing and the metal locking head is positioned in the upper level of the housing. The tie body wraps around a cable bundle, through the lower level of the housing for multiple loops, through the upper level of the housing, and through the metal locking head to secure the metal locking cleat.

19 Claims, 10 Drawing Sheets

BI-LEVEL METAL LOCKING CLEAT

FIELD OF THE INVENTION

The present invention relates to a metal locking cleat, and more particularly to a bi-level metal locking cleat with improved strength.

BACKGROUND OF THE INVENTION

Metallic bundling devices incorporating locking balls and roller pins have been used for bundling bales of cotton or the like since the Nineteenth Century. None of the prior devices were positive locking, i.e., depending on the orientation of the locking head, gravity could hold the ball out of locking engagement with the strap resulting in release. U.S. Pat. No. 4,399,592 addressed this problem by teaching the addition of a raised portion or protuberances for deflecting the threaded strap away from the floor as the threaded strap exits the locking head. This deflection ensures that the locking ball is in continuous engagement with the threaded strap regardless of the position of the ball or the orientation of the locking head.

U.S. Pat. No. 8,635,745 discloses a metal ball locking tie with a bi-level head. FIGS. 1A and 1B illustrate the prior art metal ball locking tie with bi-level head 20. The metal locking tie with bi-level head has a high loop tensile strength compared to other metal locking ties. The metal ball locking tie with bi-level head, however, is difficult to manufacture. A progressive die is required to stamp the bi-level head which would require a number of stamping stations, a large die, and a large press bed. Additionally, threading multiple tie loops through the bi-level head is complicated and too difficult when the metal locking tie is wrapped around a small diameter cable bundle.

U.S. Pat. No. 9,783,350 discloses a metal ball locking tie with an extended support clip. The extended support clip provides floor support to the head of the metal ball locking tie to withstand impulse forces.

Stainless steel strap cable cleats (MS 75 straps) have been used for securing a bundle of cables and for providing short circuit protection. The stainless steel strap cable cleats are stronger than metal ball locking ties for a number of reasons. The strap body is generally wider and thicker than metal ball locking ties. The stainless steel strap can be triple looped during installation instead of just doubled looped. Finally, the strap body withstands an impulse force, such as a short circuit event or a military application, compared to metal ball locking ties. Stainless steel strap cable cleats, however, are challenging to install. Threading the stainless steel strap is difficult especially for small diameter cable bundles. Additionally, tools are required for installation of the stainless steel strap cable cleats and closing the strap buckle is often difficult.

Thus, it would be desirable to provide an improved metal locking cleat for securing a bundle of cables that is easier to install and is capable of withstanding strong impulse forces or short circuit events.

SUMMARY OF THE INVENTION

A metal locking cleat for securing cable bundles is disclosed. The metal locking cleat has a multi-level housing, a tie body, and a metal locking head. The multi-level housing includes a top, a bottom, sides, a front, a back, an upper level, and a lower level. The tie body is positioned in the lower level of the housing. The metal locking head is positioned in the upper level of the housing. To install the metal locking cleat, the tie body wraps around a cable bundle and through the lower level of the housing for multiple loops. Next, the tie body extends through the upper level of the housing and through the metal locking head to secure the metal locking cleat.

DETAILED DESCRIPTION

Figure 1A:
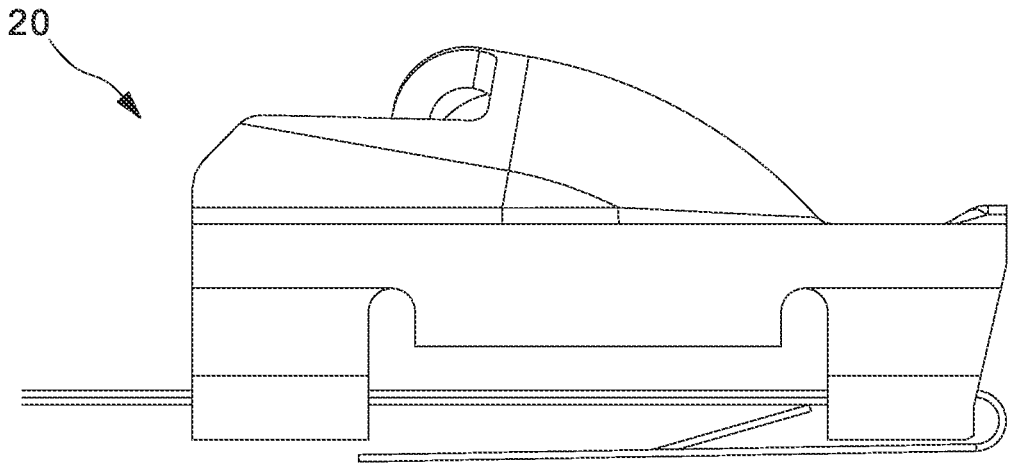
FIG.1A Prior Art
FIG. 1A is a side view of a prior art metal locking tie with a bi-level head.
Figure 1B:
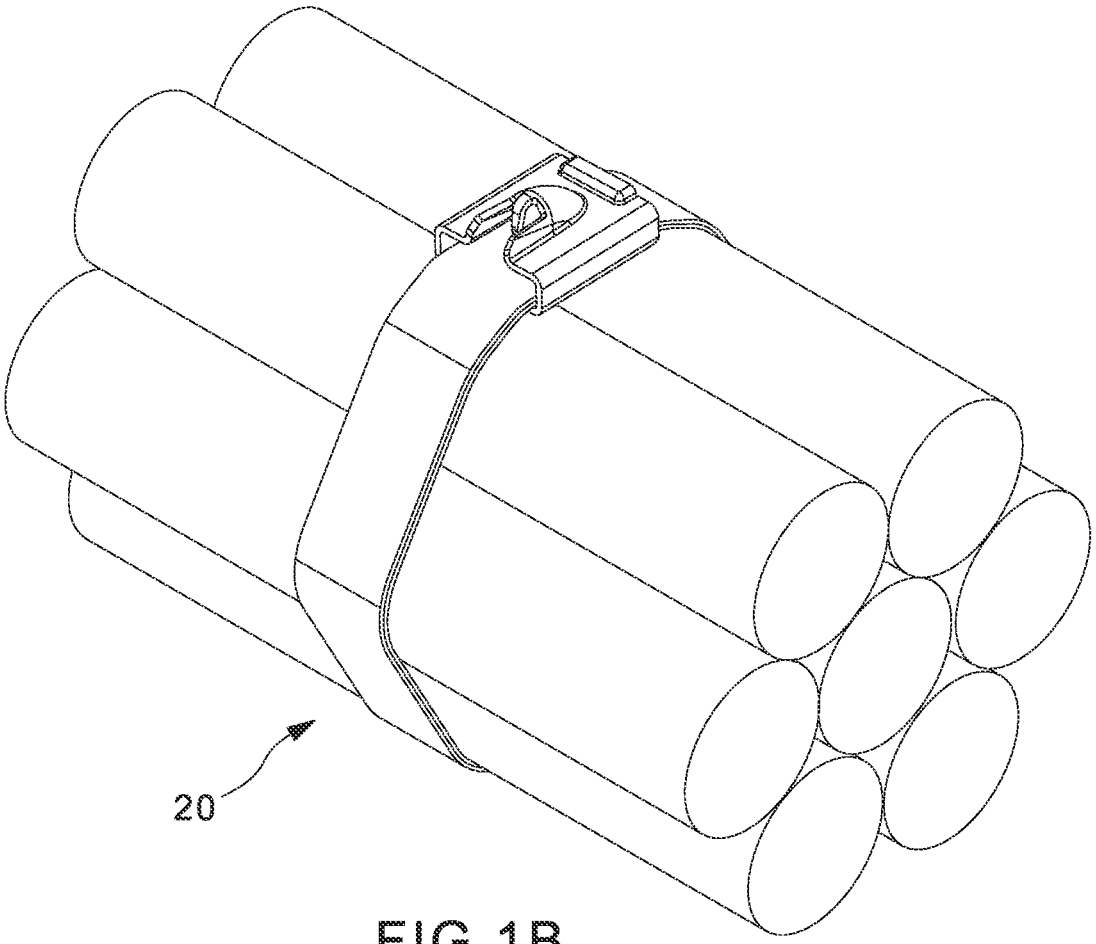
FIG.1B Prior Art
FIG. 1B is a perspective view of the metal locking tie with a bi-level head of FIG. 1 installed around a cable bundle.
Figure 2:
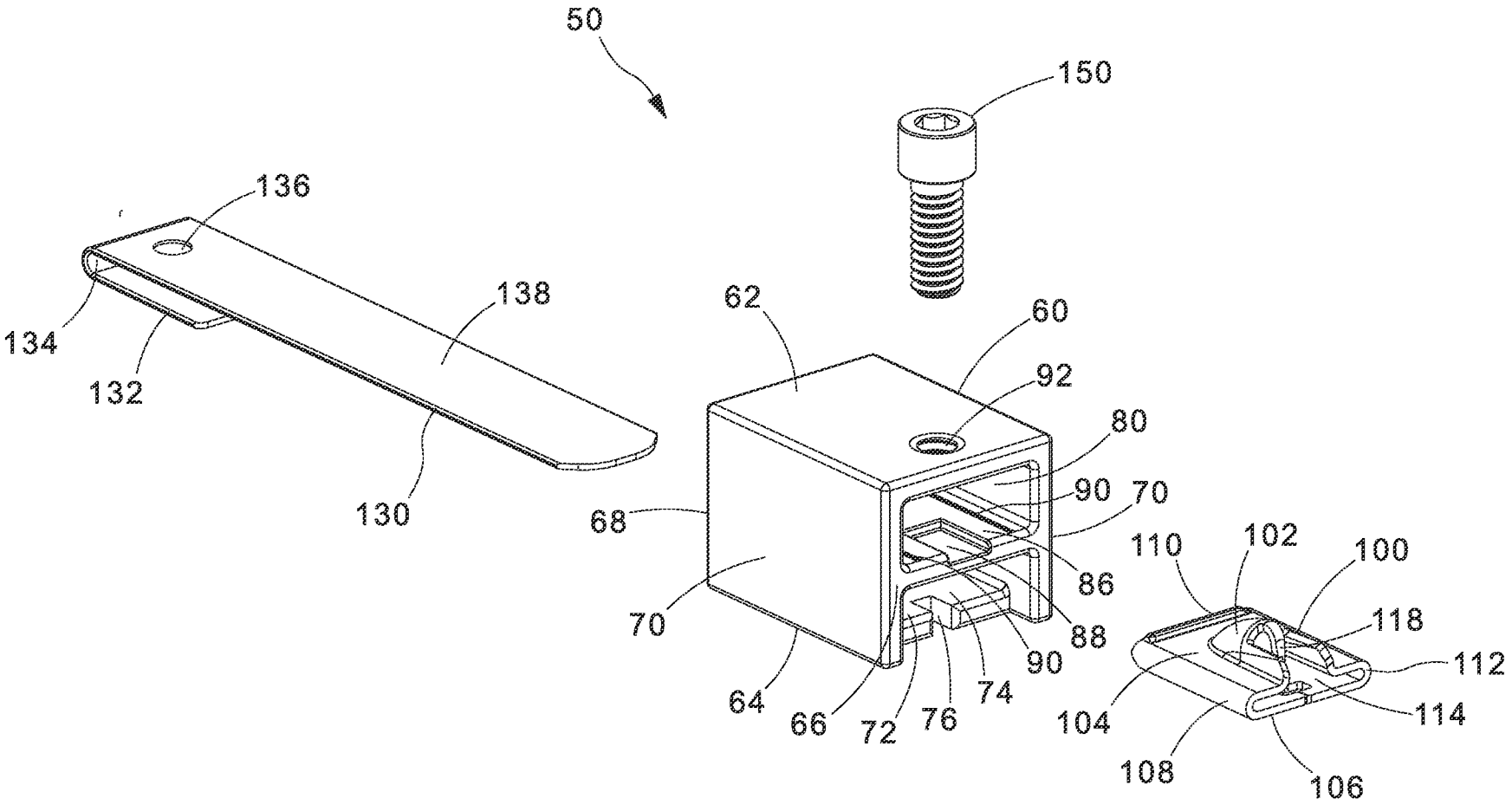
FIG. 2 is an exploded view of the bi-level metal locking cleat of the present invention.

FIG. 2 is an exploded view of the bi-level metal locking cleat 50 of the present invention. The bi-level metal locking cleat 50 includes a stainless steel housing 60, a metal locking head 100, a tie body 130, and a fastener 150. The metal locking head 100 and tie body 130 form a standard metal locking tie as described in commonly owned U.S. Pat. No. 6,647,596, herein incorporated by reference.

Figure 3:
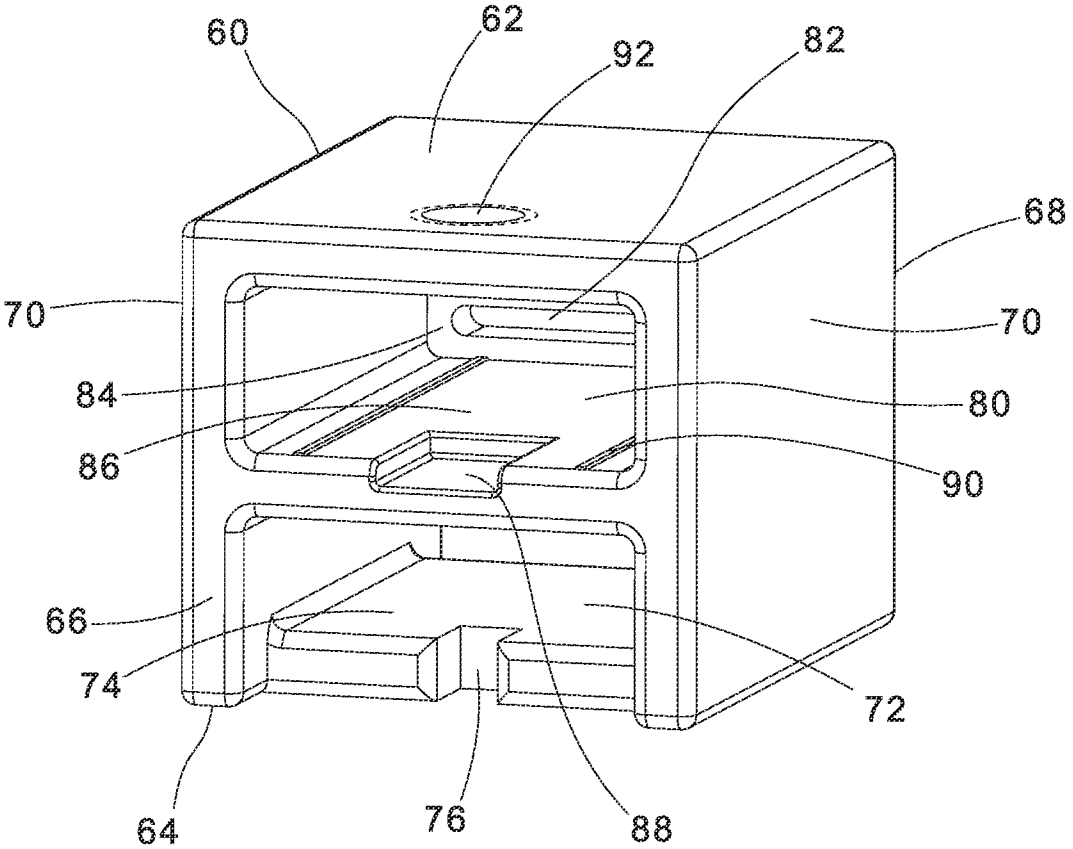
FIG. 3 is a perspective view of the metal locking cleat housing of FIG. 2.

FIG. 3 illustrates a perspective view of the housing 60 of the bi-level metal locking cleat 50. The housing 60 includes a top wall 62, a bottom wall 64, an open front 66, a partially open back 68, and two sidewalls 70. The housing 60 is divided into a lower level 72 and an upper level 80.

The lower level 72 includes a short lower level floor 74 that is centered between the front 66 and the back 68 of the housing 60. The short lower level floor 74 has a body shear form cutout 76 for attachment of the tie body 130. The lower level floor 74 is shorter than the upper level 80 to maximize the number of loops of the tie body 130 by controlling the arc peak of the tie body 130 when it is installed in the lower level 72.

The sidewalls 70 of the housing 60 fully support the upper level 80. The back 68 of the upper level 80 is enclosed except for a pass thru slot 82 designed to receive the last loop of the tie body 130 that is then fed through the metal locking head 100. The remainder of the back 68 of the upper level 80 of the housing 60 forms a head retainment wall 84 to keep the metal locking head 100 in the housing 60 when the metal locking cleat 50 is under tension.

Figure 8:
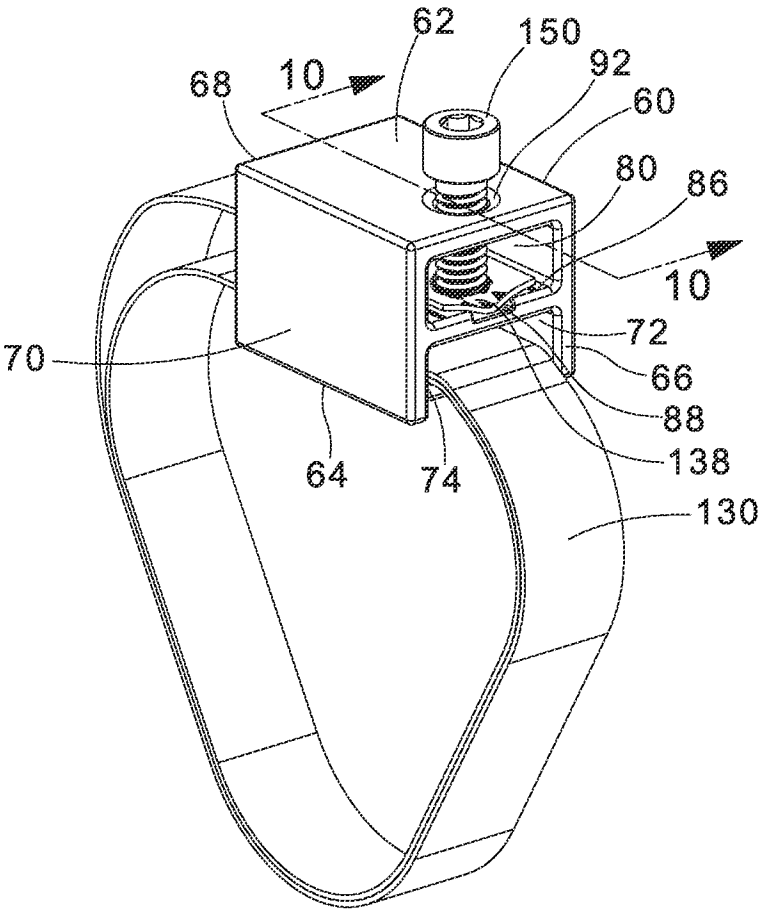
FIG. 8 is a perspective view of the bi-level metal locking cleat of FIG. 7 with the fastener tightened and the tie body deformed.
Figure 9:
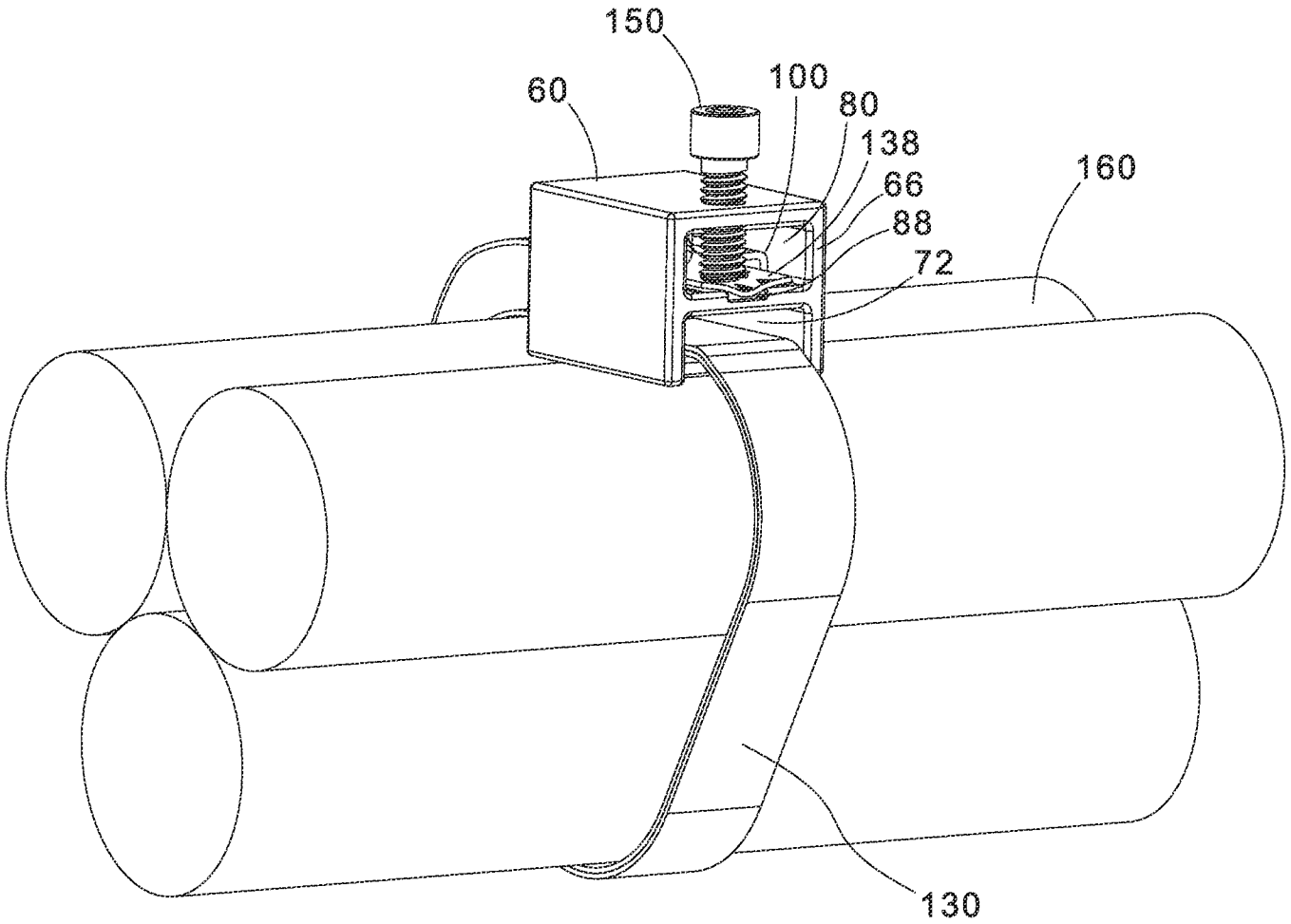
FIG. 9 is a perspective view of the bi-level metal locking cleat of FIG. 8 wrapped around a cable bundle.

The upper level 80 includes an upper level floor 86 with a tie body lock recess 88 that receives the tie body 130 when the fastener 150 is tightened and deforms the tie body 130 (see FIGS. 8 and 9). The deformed tie body 130 increases the strength of the metal locking cleat 50 and improves resistance to slippage during impulse forces.

The upper level floor 86 also includes head retainment ribs 90. One head retainment rib 90 is positioned on each side of the tie body lock recess 88. The head retainment ribs 90 create an interference fit between the metal locking head 100 and the housing 60. The top wall 62 of the housing, or the ceiling of the upper level 80, has a threaded fastener hole 92. The threaded fastener hole 92 is positioned above the tie body lock recess 88.

Figure 10:
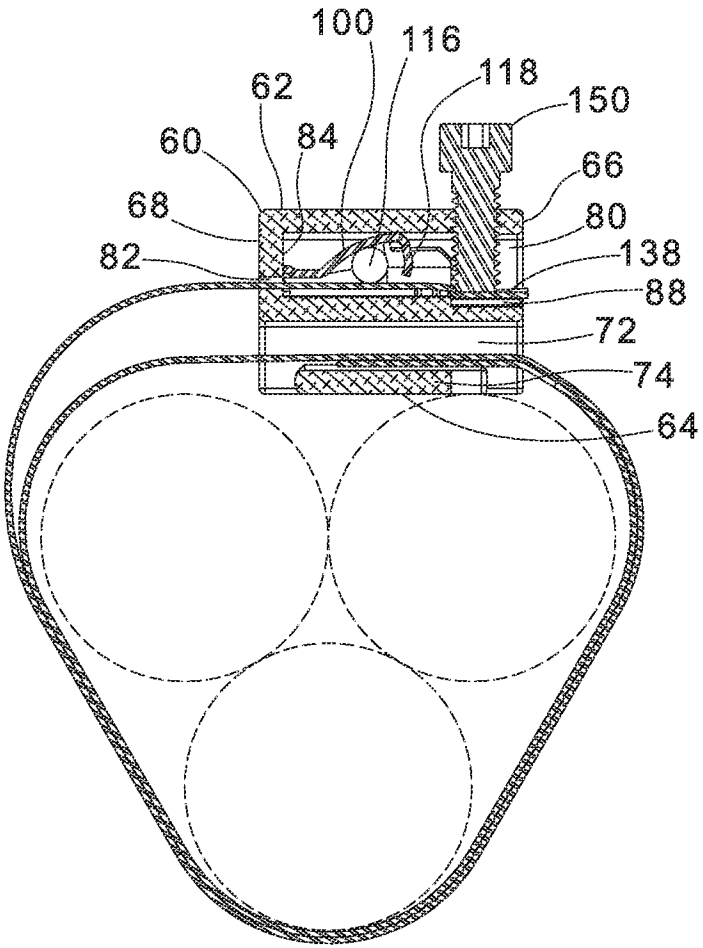
FIG. 10 is a cross sectional view of the bi-level metal locking cleat of FIG. 8 taken along line 10-10.

The metal locking head 100 has a roof 102, a ceiling 104, and a bottom wall 106. The bottom wall 106 and ceiling 104 are joined by a pair of sidewalls 108. The metal locking head 100 has a strap entry face 110, a strap exit face 112, and a strap receiving aperture 114 extending therebetween. The metal locking head 100 includes a roller means 116 in the form of a ball or sphere for retaining the tie body 130 within the locking head 100 (see FIG. 10). The ball 116 is captively held between the roof 102 and the bottom wall 106 by a finger 118 extending from the roof 102 towards the bottom wall 106 adjacent to the strap exit face 112. The tie body 130 includes a first end 132, a hooked portion 134, an aperture 136 and a second end 138. The tie body 130 could also include a locking tab (not illustrated), if desired.

Figure 4:
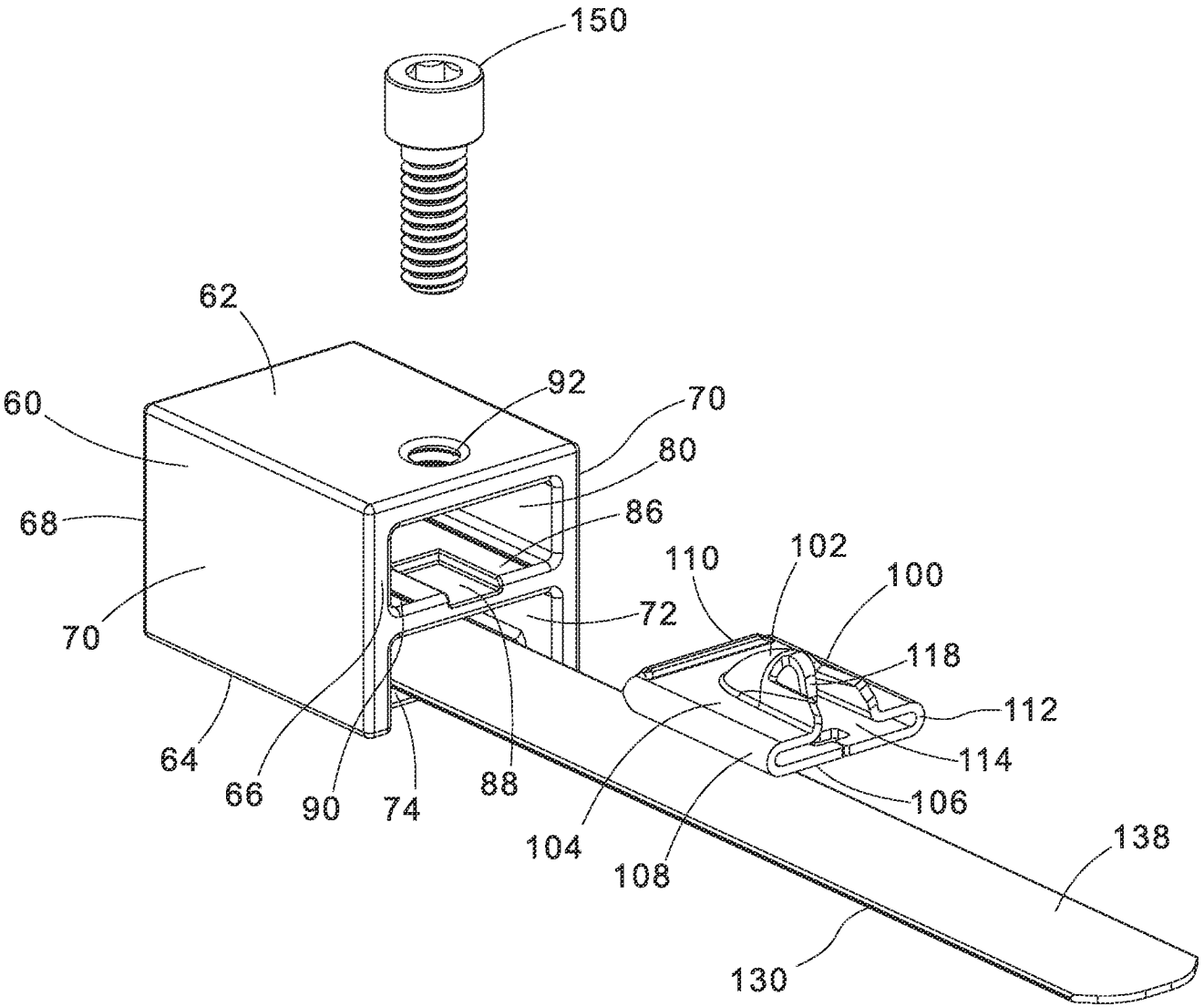
FIG. 4 is a partially exploded view of the bi-level metal locking cleat of FIG. 2 with a first end of the tie body installed in the housing.
Figure 5:
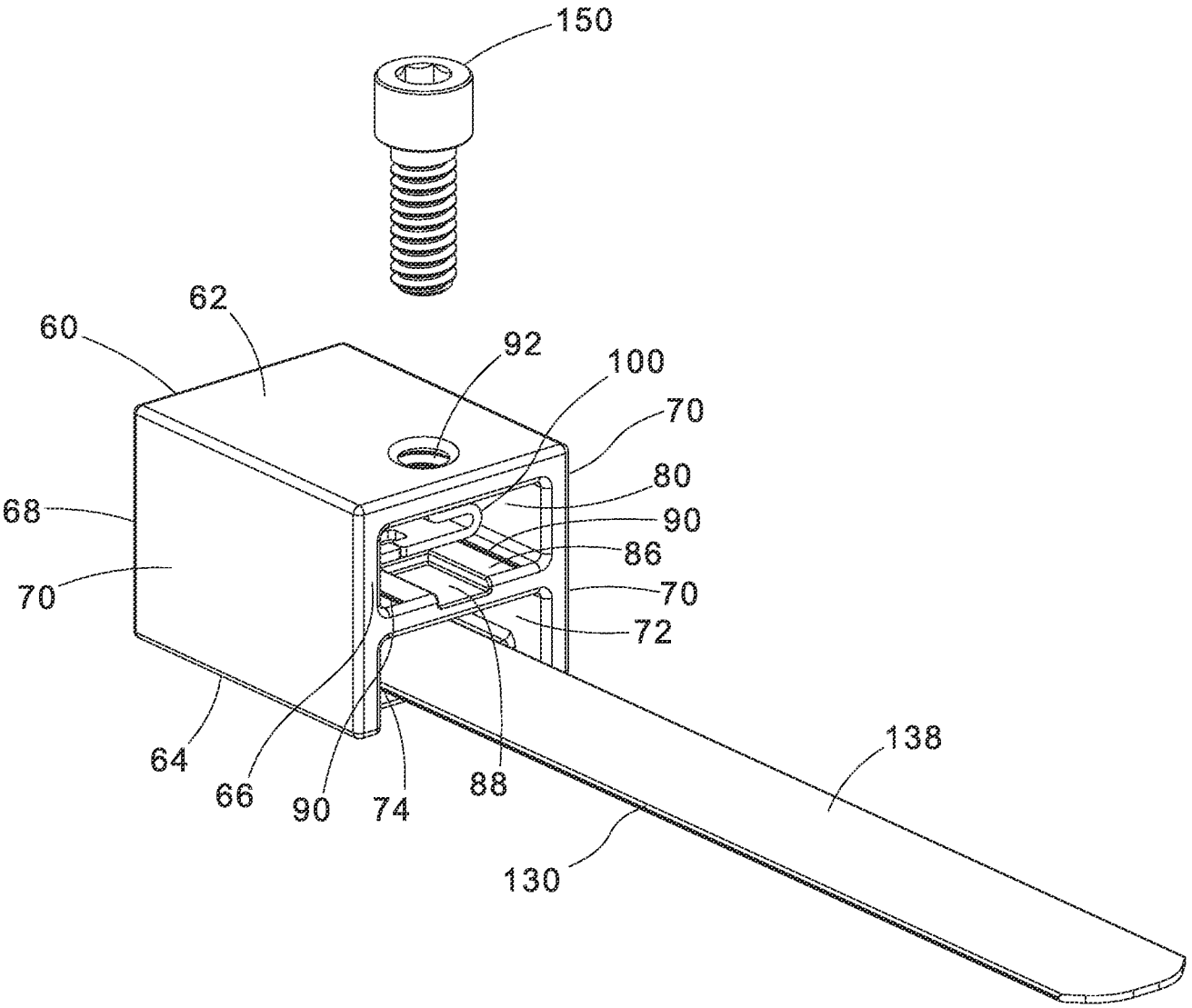
FIG. 5 is a partially exploded view of the bi-level metal locking cleat of FIG. 4 with the metal locking head installed in the housing.
Figure 6:
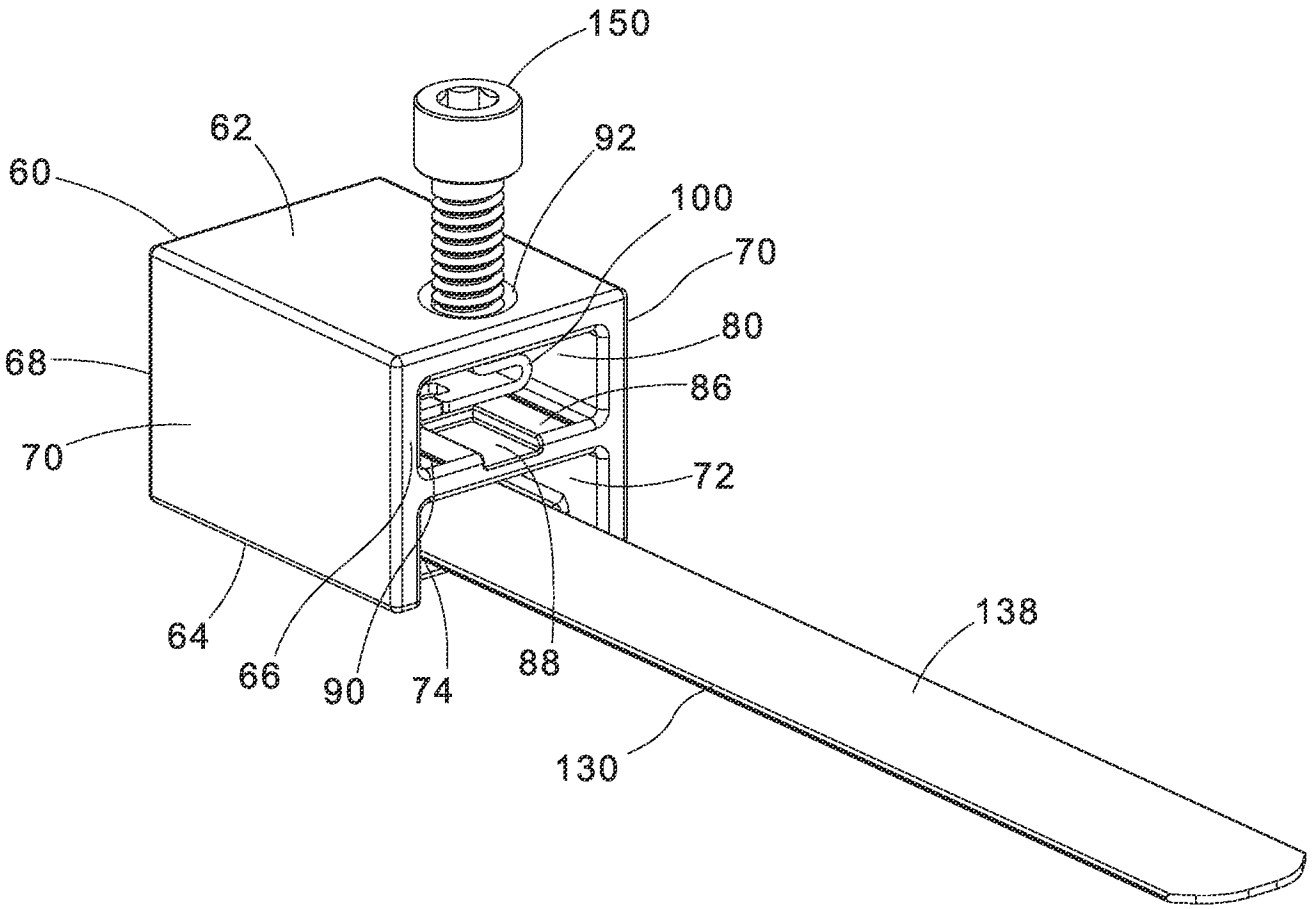
FIG. 6 is a perspective view of the assembled bi-level metal locking cleat of FIG. 2.
Figure 7:
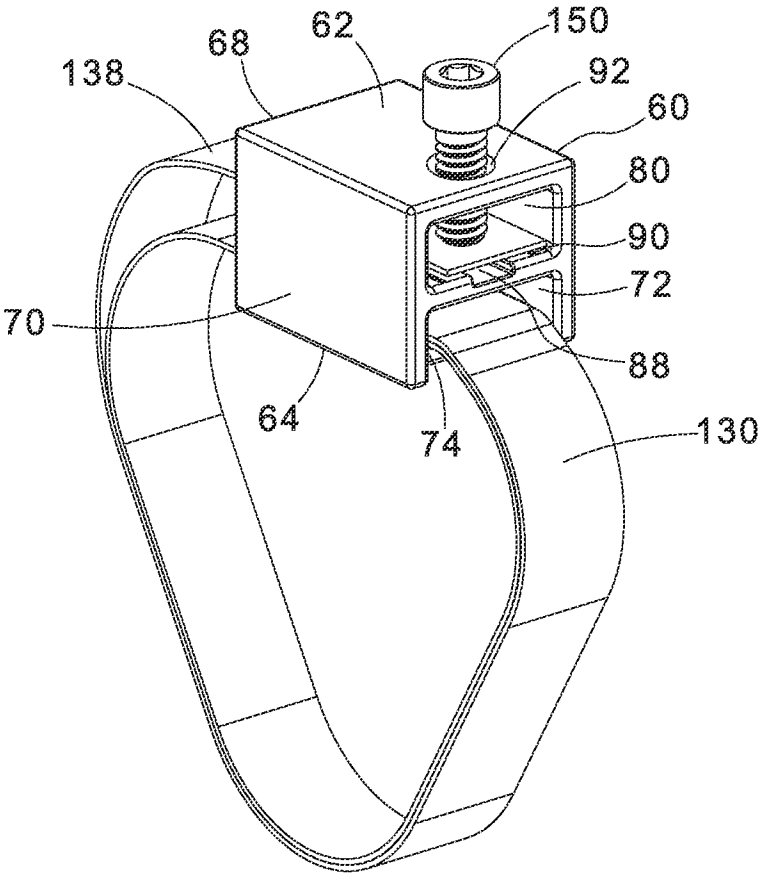
FIG. 7 is a perspective view of the bi-level metal locking cleat of FIG. 6 with a second end of the tie body fed through the housing and the metal locking head.

FIGS. 4-10 illustrate the assembly of the bi-level metal locking cleat 50 of the present invention. The bi-level metal locking cleat 50 requires a small amount of assembly at the factory that includes positioning the metal locking head 100 into the upper level 80 of the housing 60, positioning fastener 150 into the threaded fastener hole 92, and positioning the tie body 130 in the lower level 72 of the housing 60. The tie body 130 could also be field installed in the housing, if desired. As illustrated in FIG. 4, the tie body 130 is positioned in the lower level 72 of the housing 60. The tie body 130 is wrapped around the short lower level floor 74 and the bottom wall 64 of the housing 60 (see FIG. 10). The metal locking head 100 is positioned within the upper level 80 of the housing 60 (see FIG. 5). The metal locking head 100 is retained in the housing 60 by an interference fit created by the sidewalls 70 and the head retainment ribs 90. The final step for initial assembly is that the fastener 150 is positioned within the threaded fastener hole 92 in the top wall 62 of the housing 60 (see FIG. 6).

The tie body 130 is then looped around a cable bundle 160 (see FIG. 9) and reinserted in and through the lower level 72 of the housing 60. The desired number of tie loops needs to be determined to achieve the required strength of the metal locking cleat 50. Once the desired number of tie loops of the tie body 130 has been achieved, the last tie loop of the tie body 130 is inserted and pushed through the pass thru slot 82 in the upper level 80 of the housing 60 and through the metal locking head 100. The last tie loop of the tie body 130 should be pushed through the metal locking head 100 as far as possible before attaching a flush cut tensioning tool to the second end 138 of the tie body 130. The tie body 130 is then tensioned by the tool to the desired tension level and cut flush to the housing 60. The housing remains perpendicular to the cable bundle throughout assembly. Once the tie body 130 has been tensioned, the fastener 150 may be tightened to the desired torque. As the fastener 150 is tightened, the tie body 130 deforms into the body lock recess 88 in the upper level floor 86 of housing 60 (see FIGS. 8 and 9).

The bi-level metal locking cleat of the present invention provides the required strength to withstand impulse forces. The bi-level metal locking cleat is easy to assemble and allows multiple loops of the tie body to achieve the strength requirements. The bi-level metal locking cleat can also be easily installed in confined spaces as the tie body of the metal locking cleat is tensioned and cutoff without the need of rotating any tool.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

What is claimed is:

1. A metal locking cleat for securing cable bundles, the metal locking cleat comprising:

a housing having a top, a bottom, sides, a front, a back, an upper level, and a lower level;

a tie body positioned in the lower level of the housing;

a metal locking head positioned in the upper level of the housing; and wherein the upper level of the housing has a head retainment wall along the back of the housing for maintaining the metal locking head in the housing;

whereby the tie body wraps around a cable bundle and through the lower level of the housing, through the upper level of the housing, and through the metal locking head to secure the metal locking cleat.

2. The metal locking cleat of claim 1, wherein the lower level of the housing has a short lower level floor centered between the front of the housing and the back of the housing.

3. The metal locking cleat of claim 2, wherein the short lower level floor is shorter than the upper level of the housing.

4. The metal locking cleat of claim 1, wherein the housing further comprising a fastener hole in the top of the housing for receiving a fastener to engage the tie body fed through the metal locking head.

5. The metal locking cleat of claim 1, wherein the back of the housing has a pass thru slot into the upper level for receiving the tie body.

6. The metal locking cleat of claim 1, wherein the upper level of the housing has head retainment ribs positioned on a floor of the upper level, the head retainment ribs provide an interference fit for the metal locking head positioned in the housing.

7. A metal locking cleat assembly comprising:

a multi-level housing having a top, a bottom, sides, a front, a back, an upper level, and a lower level;

a tie body having a first end and a second end, the first end of the tie body wrapped around the lower level of the multi-level housing;

a metal locking head positioned within the upper level of the multi-level housing; and a fastener installed through the top of the multi-level housing;

whereby the tie body wraps around a cable bundle and through the lower level of the multi-level housing, through the upper level of the multi-level housing, and through the metal locking head to secure the metal locking cleat assembly.

8. The metal locking cleat assembly of claim 7, wherein the lower level of the multi-level housing has a short lower level floor centered between the front of the multi-level housing and the back of the multi-level housing.

9. The metal locking cleat assembly of claim 8, wherein the short lower level floor is shorter than the upper level of the multi-level housing.

10. The metal locking cleat assembly of claim 7, wherein the fastener engages the second end of the tie body fed through the metal locking head.

11. The metal locking cleat assembly of claim 10, wherein the upper level of the housing has an upper level floor with a tie body lock recess, whereby tightening the fastener deforms the second end of the tie body into the tie body lock recess.

12. The metal locking cleat assembly of claim 11, wherein the deformed second end of the tie body increases the strength of the metal locking cleat assembly and improves resistance to slippage.

13. The metal locking cleat assembly of claim 7, wherein the housing further comprising a threaded fastener hole in the top of the housing for receiving the fastener to engage the tie body fed through the metal locking head.

14. The metal locking cleat assembly of claim 7, wherein the back of the multi-level housing has a pass thru slot leading into the upper level of the multi-level housing for receiving the tie body.

15. The metal locking cleat assembly of claim 7, wherein the upper level of the multi-level housing has a head retainment wall along the back of the multi-level housing for maintaining the metal locking head in the multi-level housing.

16. The metal locking cleat assembly of claim 7, wherein the upper level of the multi-level housing has head retainment ribs positioned on a floor of the upper level, the head retainment ribs provide an interference fit for the metal locking head positioned in the multi-level housing.

17. A metal locking cleat for securing cable bundles, the metal locking cleat comprising:

a housing having a top, a bottom, sides, a front, a back, an upper level, and a lower level;

a tie body positioned in the lower level of the housing;

a metal locking head positioned in the upper level of the housing; and the upper level of the housing has an upper level floor with a tie body lock recess;

whereby the tie body wraps around a cable bundle and through the lower level of the housing, through the upper level of the housing, and through the metal locking head to secure the metal locking cleat.

18. The metal locking cleat of claim 17, wherein the housing has a threaded fastener hole in the top of the housing for receiving a fastener, whereby the tightened fastener deforms the tie body into the tie body lock recess.

19. The metal locking cleat of claim 18, wherein the deformed tie body increases the strength of the metal locking cleat and improves resistance to slippage.

* * * * *